United States Patent [19]

Lenk et al.

[11] Patent Number: 4,645,444

[45] Date of Patent: Feb. 24, 1987

[54] MELT SPINNING APPARATUS

[75] Inventors: Erich Lenk; Max Feth, both of Remscheid, Fed. Rep. of Germany

[73] Assignee: Barmag Barmer Maschinenfabrik Aktiengesellschaft, Remscheid, Fed. Rep. of Germany

[21] Appl. No.: 593,034

[22] Filed: Mar. 23, 1984

[30] Foreign Application Priority Data

Mar. 23, 1983 [DE] Fed. Rep. of Germany ..... 3310521

[51] Int. Cl.[4] ..... D01D 4/08

[52] U.S. Cl. ..... 425/192 S; 264/176 F; 264/176.1; 425/378 S; 425/379 S; 425/464

[58] Field of Search ..... 425/182, 192 S, 378 S, 425/378 R, 379 R, 379 S, 382.2, 131.5, 461, 464, 72 S, 197, 198, 190; 264/176 F

[56] References Cited

U.S. PATENT DOCUMENTS

| | | | |
|---|---|---|---|
| 2,786,504 | 3/1957 | Samler | 137/547 |
| 2,838,084 | 6/1958 | Samler | 137/15 |
| 3,480,995 | 12/1969 | Lenk | 425/464 |
| 3,500,499 | 3/1970 | Goossens | 425/192 R |
| 3,516,119 | 6/1970 | Keller | 425/191 |
| 3,559,237 | 2/1971 | van den Biggelaar | 425/131.5 |
| 3,562,858 | 2/1971 | Lehner | 425/379 |
| 3,655,314 | 4/1972 | Lenk et al. | 425/378 S |
| 3,667,886 | 6/1972 | Gauthier et al. | 425/192 S |
| 3,762,854 | 10/1973 | Kilsdonk | 425/382.2 |
| 3,864,068 | 2/1975 | Flakne | 425/378 S |
| 3,891,379 | 6/1975 | Lenk | 425/464 |
| 4,035,127 | 7/1977 | Ogasawara et al. | 425/378 S |
| 4,038,005 | 7/1977 | Lenk | 425/190 |
| 4,050,866 | 9/1977 | Kilsdonk | 425/192 S |
| 4,285,651 | 8/1981 | Fetchu et al. | 425/192 R |
| 4,321,228 | 3/1982 | de Kok | 264/209.8 |
| 4,361,489 | 11/1982 | Kilsdonk et al. | 425/197 |
| 4,413,968 | 11/1983 | Bliss | 425/198 |
| 4,437,827 | 3/1984 | Moderlak et al. | 425/378 S |
| 4,493,628 | 1/1985 | Lenk | 425/192 |
| 4,494,921 | 1/1985 | Sowell | 425/198 |

FOREIGN PATENT DOCUMENTS

| | | | |
|---|---|---|---|
| 2639282 | 3/1978 | Fed. Rep. of Germany . | |
| 46-33727 | 10/1971 | Japan | 425/198 |
| 53-02618 | 1/1978 | Japan | 425/192 S |
| 1350496 | 4/1974 | United Kingdom . | |

OTHER PUBLICATIONS

W. H. Hills, "Anatomy of a Spin Beam", *Fiber Producer,* Dec. 1981, pp. 34, 36, 38, 40, 42, and 43.

*Primary Examiner*—Jay H. Woo
*Assistant Examiner*—J. Fortenberry
*Attorney, Agent, or Firm*—Bell, Seltzer, Park & Gibson

[57] ABSTRACT

A melt spinning apparatus is disclosed which is adapted for dividing a molten polymer into a plurality of streams to form synthetic filaments. The apparatus comprises a spin block assembly having two opposite sides, and two separate heating chambers disposed adjacent respective ones of the sides of the spin block assembly. The two heating chambers are interconnected by threaded members, so that the opposing surfaces of the chambers may be drawn together to clampingly engage the opposite sides of the spin block assembly therebetween. The formation of air gaps between the opposing surfaces, and which might hinder the heat transfer between the heating chamber and spin block, are thereby avoided. In one embodiment, the threaded members extend through spacers which are mounted between the heating chambers and between adjacent spin block assemblies, with the spacers being essentially thermally nonconductive, and so that substantially all the heat flow to each spin block assembly is received from the opposing side wall surfaces of the two heating chambers.

24 Claims, 4 Drawing Figures

MELT SPINNING APPARATUS

The present invention relates to a melt spinning apparatus of the type adapted for dividing a molten polymer into a plurality of streams to form synthetic filaments. In the context of the present invention, filaments are understood to be endless, linear structures which are continuously extruded, and which may take the form, for example, of mono or multifilaments, tapes, strands, bristles, tows, or the like.

Known melt spinning apparatus have replaceable spin block assemblies, which are inserted in heat exchange relation into mating recesses of an enclosing heating jacket, with the melt inlet duct being sealed against the melt supply duct by means of a clamping screw or the like. Each spin block assembly includes a spin plate, which has a plurality of holes or ducts through which the polymer is extruded to form individual filaments. Depending on the particular application, spin plates having different hole patterns may be selectively utilized, which improves the flexibility of the spinning operation for the fiber producer. The dimensions of the recess in the heating jacket for receiving the spin block assembly, and the exterior dimensions of the assembly are substantially identical, and it is therefore possible, for example, to insert a spin plate with a rectilinear hole pattern (rectangular spin plate) to produce tow for the production of staple fiber yarn or carpet yarn, or to insert a circular spin plate (cup-shaped spinneret) to produce textile or industrial endless filaments of different deniers, while the spinning apparatus remains essentially unchanged in its constructional design. Only the spin block assemblies are thus exchanged.

It is recognized that a uniform heating of the spin block assembly is necessary to achieve high quality spun filaments. In practice, it is difficult to accomplish a uniform heating of the spin plates, particularly when several spin block assemblies are juxtaposed side by side in an elongate spin beam, and where different heat transfer conditions exist for the spin plates positioned at the ends of the beam as compared to those which are arranged between other spin block assemblies.

Heat is transferred from the heating jacket to the respective spin plate via the spin plate holder of the spin block assembly. In the apparatus illustrated for example in German OS No. 16 60 501, the holder is held against the pump block by means of clamping screws which engage one side of the heating jacket, so that the melt distributing duct is sealed against the supply lines from the source of the melt. In so securing the spin block assembly, the assembly contacts at the most one longitudinal wall of the heating jacket with one of its front sides, and relatively large air gaps are present on the other circumferential surfaces. Such air gaps are undesirable, in that they adversely effect the heat transfer, but cannot be avoided in the known constructions of heating jackets, by reason of manufacturing tolerances and different thermal expansions of the materials utilized for the heating jacket and the spin block assembly.

In view of the above noted problems associated with the prior art, it is an object of the present invention to provide a melt spinning apparatus adapted for heating replaceable spin block assemblies in an elongated spin beam, and wherein the heat is uniformly transferred to two opposite sides of each spin block assembly.

It is a further object of the present invention to provide a melt spinning apparatus which is adapted to readily permit the changing or maintenance of the spin block assemblies, without complete disassembly of the entire spinning head.

It is also an object of the present invention to provide a melt spinning apparatus wherein the design of the heating jacket is such as to permit acceptance of spin block assemblies of various designs, and so that the design of the heating jacket may be standardized and only the design of the spin block assemblies will change in accordance with the particular needs of the user.

These and other objects and advantages of the present invention are achieved in the embodiment illustrated herein by the provision of a melt spinning apparatus which comprises a spin block assembly having two opposite sides, with the spin block assembly including a spin plate having a plurality of ducts extending therethrough and cavity means communicating with one side of the spin plate for supplying a molten polymer or the like to the ducts. The apparatus further includes heating jacket means substantially enclosing the spin block assembly, with the heating jacket means including two separate heating chambers disposed adjacent respective ones of the opposite sides of the spin block assembly. Each heating chamber further includes a side wall surface overlying and contacting the adjacent side of the spin block assembly, and threaded members are provided for releasably interconnecting the two heating chambers so that the side wall surfaces of the two heating chambers may be drawn toward each other to clamp the spin block assembly therebetween.

Thus in accordance with the present invention, the heating jacket means is composed of two separate parts, specifically, two mechanically independent heating chambers which are adapted to be adjusted relative to each other, and with the heating chambers accommodating the melt delivery block, and the metering pumps and drives, which may be fixedly mounted thereto.

An advantage of the above described heating jacket means is the fact that a large, metal to metal heat transfer area may be provided with respect to the spin block assembly, despite the unavoidable manufacturing tolerances and thermal expansion of the components. Further, the width of the spin block assemblies need not be controlled by the design of the heating jacket and the recesses provided therein.

In an advantageous embodiment of the present invention, the side wall surfaces of the two heating chambers between which the spin block assemblies are held, are designed as essentially flat contact surfaces having a smooth surface finish. In particular, the surfaces may be machined to a high degree of smoothness, so that the heat transfer from the side wall surfaces of the heating chambers to the spin block assemblies is enhanced by the large, metal to metal contact therebetween. In addition, the heating jacket means may include heat conducting blocks, having rectangular, flat side walls for contacting a portion of the opposite sides of the spin block assemblies.

The two mechanically separate heating chambers and the spin block assemblies are preferably pressed against each other so as to eliminate any gaps therebetween, by means of threaded members which extend transversely between the two heating chambers. The threaded members are provided in sufficient numbers to insure a sufficient contact pressure between the chambers and spin block assemblies over the entire length of the spin beam. To facilitate the installation of the spin block assemblies between the separate heating chambers, the threaded members preferably do not extend through the assemblies themselves. Rather, the threaded members extend through bridging spacers which are positioned at the ends of the spin beam and distributed at selected intervals along the length of the beam. Also, the length of such spacers closely corresponds to the width of the spin blocks assemblies, i.e. the distance between the two opposite sides of the assemblies which are in contact with the chambers. By this arrangement, the entire heating jacket means may remain essentially assembled, while the spin block assemblies are exchanged to permit routine maintenance, or change of the spinning program, etc. Such an arrangement is advantageous in that the heating ducts, and the outer heat insulation layer and the like is undisturbed. The apparatus further provides for the easy removal of the spin block assemblies, which requires only that the threaded members be loosened, which causes the two chambers to be slightly separated, and which permits the spin block assemblies to be readily removed. Still another advantage resides in the fact that non-heat conductive materials may be used for the spacers, so that the spin block assemblies are essentially heated only at their two opposite sides which contact the two heating chambers, and they are controllably heated from the lateral sides.

The two heating chambers may be heated in various ways. For example, both heating chambers may be selfcontained and partially filled with a vaporizable heating medium. Electric resistance heating means or the like may then be connected to each heating chamber via temperature controllers, so that identical temperatures are provided in the two heating chambers. However, it is preferred to heat both heating chambers from a single common source of heat to an essentially identical, predetermined temperature. This may be achieved by connecting the two heating chambers with flexible conduits connecting to the heating chambers in parallel, and by circulating a heating medium through the two chambers. Specifically, a condensable heating medium, such as diphenyl or the like, may be employed with provision for returning the accumulated condensate to a tank or to a central external heating system which is operated at a predetermined pressure and temperature for the saturated vapor.

Some of the objects having been stated, other objects and advantages will appear as the description proceeds, when taken in conjunction with the accompanying drawings, in which.

Figure 1:
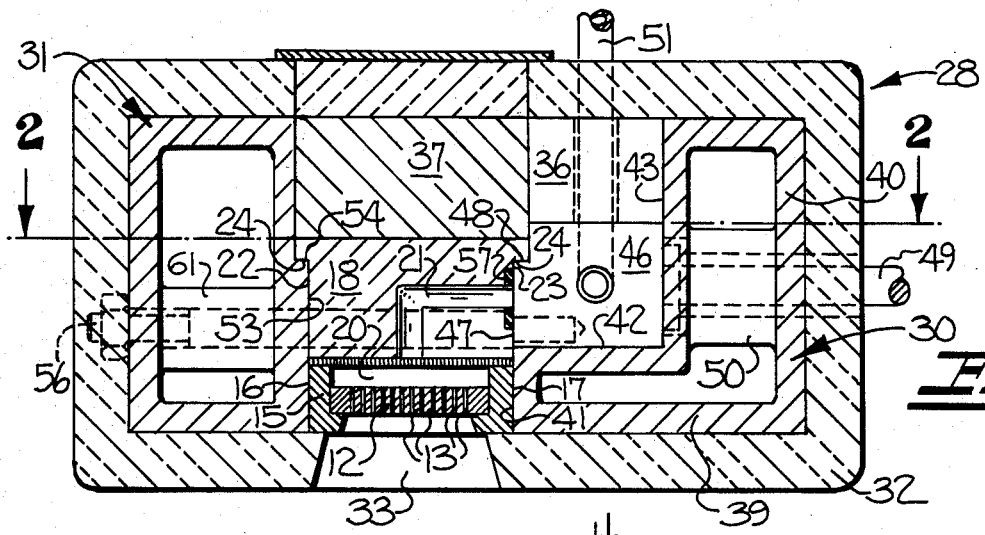
FIG. 1 is a cross-sectional view of a melt spinning apparatus which embodies the features of the present invention.
Figure 2:
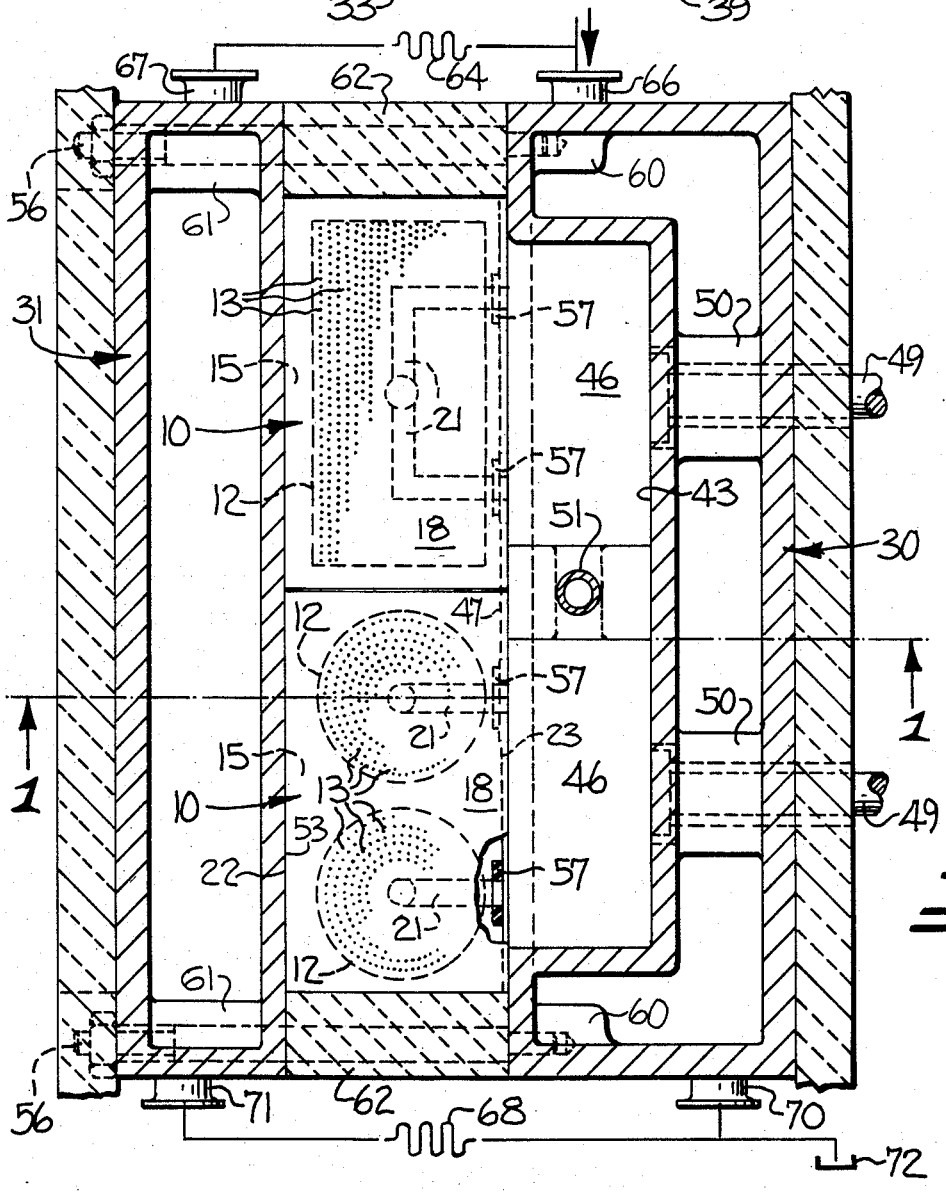
FIG. 2 is a sectional top view taken substantially along the line 2—2 of FIG. 1.

Referring more specifically to the drawings, FIG. 1 illustrates one preferred embodiment of a melt spinning apparatus which includes the features of the present invention. The apparatus may be used, for example, in synthetic filament spinning operations, and it preferably comprises groupings, called a spin beam, composed of several spinning positions. As shown in FIG. 2, the apparatus comprises several spin block assemblies 10 which are arranged side by side in the longitudinal direction to form a spin beam, which can be extended to almost any desired length.

Each spin block assembly 10 is generally rectangular, and includes at least one spin plate 12 having a plurality of ducts 13 extending therethrough. Each spin plate is supported upon the lip of a holder 15 which has a generally rectangular outline in plan view (note FIG. 2) and which surrounds the periphery of the spin plate. The opposite side surfaces 16, 17 of the holder 15 are generally flat, and extend in the longitudinal direction.

Each spin block assembly 10 also includes a cover plate 18 overlying the spin plate 12 and holder 15, and a cavity 20 is formed between the opposing faces of the spin plate and cover plate and which communicates with the ducts 21 in the cover plate so as to be adapted for supplying a molten polymer or the like thereto. The cover plate 18 is preferably fixed to the holder 15 by bolts (not shown) and sealed thereto to avoid leakage of the pressurized polymer melt in the cavity 20. In addition, the cover plate 18 has two opposite side surfaces 22, 23 which extend in the longitudinal direction, and the opposite side surfaces of the cover plate each include a downwardly facing shoulder 24 which extends longitudinally along each side surface. The portions of the opposite side surfaces 22, 23 of the cover plate lying below the shoulder 24 are coplanar with the opposite side surfaces 16, 17 of the holder 15. The opposite side surfaces 16, 17 of the holder and the opposite side surfaces 22, 23 of the cover plate will thus be seen to collectively define two opposite sides of the assembly, which are essentially flat and parallel to each other.

The apparatus further comprises heating jacket means 28 substantially enclosing the spin block assembly 10, with the heating jacket means including two separate heating chambers 30 and 31 disposed adjacent respective ones of the opposite sides of the spin block assembly 10.

The heating chambers 30, 31 are surrounded by an insulating jacket 32 to minimize heat loss, and to protect operating personnel. The insulating jacket 32 is only separated in the area immediately below the spin plates 12 of the spin block assemblies 10, where there is formed a slot-like opening 33. In the illustrated embodiment, the heating jacket means 28 is essentially U-shaped and further includes the heat conductive blocks 36 and 37, so that a heating jacket is created which surrounds all of the other structural units of the spin beam, and which ensures that all melt carrying structural members are uniformly heated.

The heating chamber 30 comprises an elongate hollow metallic member which defines a closed internal cavity, and the chamber has a generally L-shaped cross section to define a horizontal leg 39 and a vertical leg 40. The inside surfaces 41, 42, and 43 extend longitudinally along the entire length of the spin beam, and these surfaces are machined to a smooth finish to facilitate heat transfer with the melt carrying metallic structural members and the heat conductive blocks 36. A structural unit 46 in the form of a block mounts a metering pump and a melt distributing system, and the unit 46 is removably fixed upon the surface 42 of the horizontal leg 39 of the heating chamber 30.

The unit 46 includes a front surface 47 which includes a longitudinal shoulder 48 adapted to mate with a shoulder 24 of the cover plate 18. The portion of the front surface 47 of the unit 46 which is below the shoulder 48 is coplanar with the surface 41 of the chamber 30. When the spinning program is changed, for example, to multiple or bi-component spinning, the units 46 may be replaced by corresponding units, which have the same outside dimensions but are specially designed for the intended end use. The pump drive shafts 49 extend outwardly through the reinforcing sleeves 50 within the cavity of the heating chamber 30 in such a manner so as to be sealed against the passage of air. The melt is supplied to the metering pumps through ducts 51, which extend through the insulating jacket 32 and the heat conductive blocks 36. From the pumps of the units 46, the melt is delivered through the ducts 21 to the cavities 20 and to the spin plates 12. In this regard, there is further provided a central melt distributing duct (not shown) for the beam, to which the several spin plates are connected via the ducts 51. When a spinning program is changed, the blocks 36 together with the melt supply ducts 51 are also changed, if necessary.

The second heating chamber 31 is mechanically separate from the first heating chamber 30, and is designed as an elongate, generally rectangular hollow metallic member which defines an internal cavity. The height of the chamber 31 corresponds to the height of the vertical leg 40 of the heating chamber 31. Also, the front side wall surface 53 of the chamber 31 is offset at a point midway along its height to provide a longitudinal shoulder 54 which is aligned with the shoulder 48 formed in the units 46, and which mates with the shoulder 24 of the cover plate 18. By this arrangement, the two longitudinal shoulders 24 formed in the cover plate rest upon the shoulders 48 and 54, so that upon loosening of the threaded members 56, the spin block assembly 10 may be removed from its operative position between the heating chambers by lifting the cover plate 18, and attached holder 15 and spin plate 12 in the vertical direction as seen in FIG. 1. The side wall surfaces 41 and 53 of the chambers 30 and 31 extend along the entire length of the heating chambers, and contact the two opposite sides of each spin block assembly. The surfaces 41 and 53 are preferably machined to a smooth surface finish, so as to achieve a large, metal-to-metal contact area, and thus achieve good heat transfer to the spin block assemblies 10.

As indicated in FIG. 2, the spin plate 12 of the melt spinning apparatus may be rectangular with rectilinearly arranged ducts 13, or it may comprise several cupshaped spinnerets with circularly arranged ducts. Also, the threaded members 56 serve to draw the two heating chambers 30 and 31 laterally toward each other, so that the surfaces 41 and 53 clampingly engage the spin block assemblies 10 and hold the assemblies against movement. In so doing, the spin block assemblies are also sealed against the outlet ducts of the structural units 46 by the sealing rings 57. The threaded members 56 are preferably threaded into the heating chamber 30, which is fixedly mounted by reason of its connection to the melt supply line, and the pump drives as shown in FIG. 2. Specifically, the threaded members 56 are threaded into the reinforcing enlargements 60 formed in the wall of the heating chamber 30. Alternatively, the members 56 may be threaded into heat conductive blocks (not shown) which are fixedly mounted upon the horizontal leg 39 of the heating chamber 30. Such heat conductive blocks may be located between the structural units 46, and may, for example, be bolted to the horizontal leg of the chamber 30. In the heating chamber 31, the threaded members 56 extend through reinforcing sleeves 61 which extend through the cavity of the chamber 31 and are spaced equal distances corresponding to the gauge of the spin block assemblies. Also, the threaded members 56 extend through spacers 62 which are positioned between the heating chambers 30 and 31, with the length of the spacers 62 being slightly less than or closely corresponding to the width of the installed spin block assemblies 10. These spacers 62 may be composed of a heat retaining, but thermally non-conductive material. As a further example, the spacers 62 may be fabricated from stainless steel or the like.

As indicated above, the heating jacket means 28 of the embodiment of FIGS. 1 and 2 includes a plurality of heat conductive blocks 37 which overlie the spin block assemblies 10 along the entire length of the spin beam. Thus, the upper portion of the heating chamber 30 and the structural members 36 are connected in heat conducting relationship with the upper portion of the heating chamber 31. The insulating jacket 32 may include a removable segment above the blocks 37 and spin block assemblies 10. Thus, when spin block assemblies having a different width are installed, the original heat conductive blocks 37 and the removable section of the insulating jacket 32 are replaced with members of corresponding width. Such an apparatus, which permits spin block assemblies of different widths to be installed, and with a constant intensive heating of the spin plates 12, has not been possible in melt spinning apparatus of conventional design, and this advantage is seen to result from the mechanical separation of the two heating chambers 30 and 31 according to the present invention, and from the contact pressure against the spin block assemblies resulting from the threaded members 56, and which serve to fixedly hold the spin block assemblies in their operative position.

The two heating chambers 30 and 31 may be heated by a liquid or vaporous heating medium according to the processing requirements of the polymers being spun. Preferably, a condensable, organic heating medium, such as diphenyl may be used, and the temperature of the saturated vapor is controlled at the associated saturated vapor pressure. Both heating chambers 30 and 31 are connected in parallel and are supplied with the heating medium from a common generator of the saturated vapor. Also, it is preferred that a flexible duct 64, such as a metal hose or the like, be used to connect the inlets 66, 67 of the chambers 30 and 31, to compensate for the change in the distance between the chambers when the threaded members 56 are loosened and the assemblies 10 are removed. A condensate drain in the form of a flexible duct 68 is connected to each of the outlets 70 and 71 of the heating chambers, so that the accumulated condensate may be carried to a condensate collection tank 72. The illustrated arrangement of the inlet and outlet connections 66, 67 and 70, 71 should be viewed as being schematic only, and it will be understood that the placement of the connections may be dictated by the practical considerations associated with the struture of the spin beam. The two chambers 30 and 31 may alternatively be heated by a different heating system, so long as it is ensured that both chambers are heated to the same temperature and are maintained at such temperature.

Figure 3:
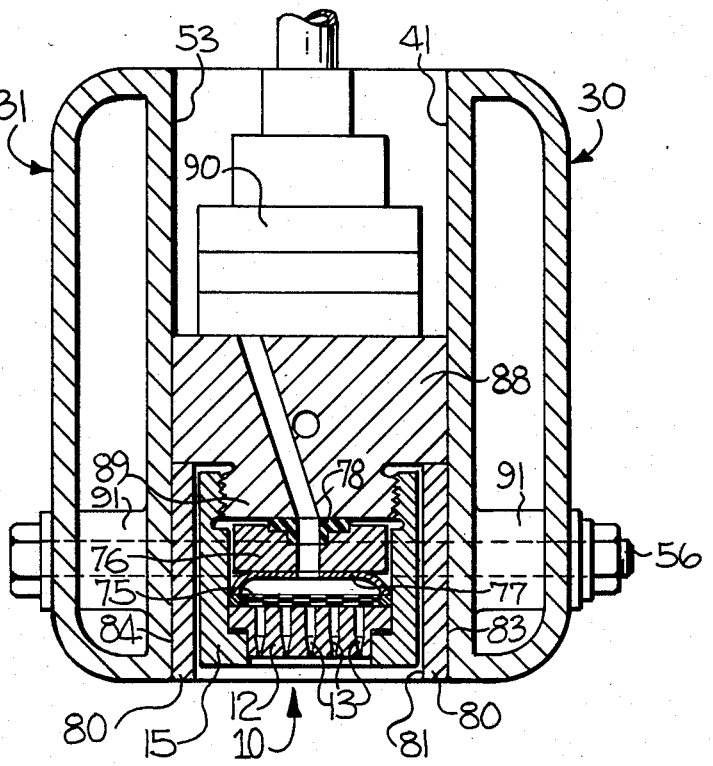
FIG. 3 is a cross sectional view of a second embodiment of a melt spinning apparatus which embodies the present invention.
Figure 4:
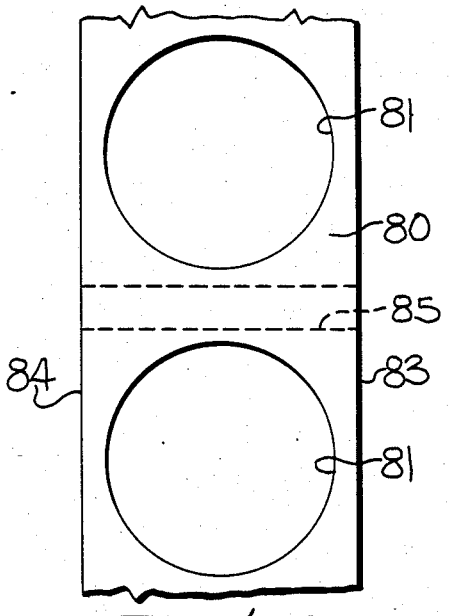
FIG. 4 is a fragmentary top plan view of the casing of the spin block assembly shown in FIG. 3.

FIGS. 3 and 4 illustrate a second embodiment of the invention. In this embodiment, the melt spinning apparatus comprises a spin block assembly 10 which includes a spin plate 12 having spinning ducts 13 therethrough. The spin plate 12 has a circular peripheral outline, and is supported upon the lower lip of a tubular holder 15. A circular filter 75 is disposed upon the upper face of the spin plate 12, and a piston 76 is disposed within the tubular holder above the spin plate and filter. A disc shaped metallic member or diaphragm 77 is attached to the lower face of the piston 76, which is also connected to the periphery of the filter 75. The piston includes a central vertical melt opening extending therethrough, and the top face of the piston mounts a gasket 78.

The spin block assembly of FIGS. 3 and 4 further comprises a spinneret casing 80 which comprises an elongate block-like member, and which is adapted to receive a plurality of the holders 15. In particular, the casing 80 includes a plurality of longitudinally spaced apart circular openings 81 which are each adapted to receive a holder 15, which in turn supports a spin plate 12 and piston 76 therewithin. The opposite side surfaces 83, 84 of the casing 80 are essentially flat surfaces which extend along the longitudinal direction, and the casing includes a plurality of transverse bores 85 spaced between selected openings 81 for receiving the threaded members 56.

The melt spinning apparatus further includes a melt distribution block 88 disposed above the spin block assembly 10, and the block 88 includes a downwardly depending extension 89 having external threads thereupon. The tubular holder 15 of the spin block assembly includes mating internal threads, so that the holder 15 may be threadedly mounted upon the extension 89, with the gasket 78 forming a seal between the extension 89 and piston 76. A melt metering pump 90 is mounted upon the distribution block and a melt supply line extends from the pump 90 through the block 88 and extension 89. This melt supply line is aligned with the melt opening extending through the piston 76, and the diaphragm 77 also includes an aligned opening. Thus a pressurized melt may be delivered from the pump 90 to the cavity disposed between the spin plate 12 and piston 76.

The apparatus of FIGS. 3 and 4 further includes two separate heating chambers 30 and 31 disposed adjacent respective ones of the sides of the spin block assembly. More particularly, each heating chamber includes an inwardly facing side wall surface 41, 53 respectively, which is essentially flat, and which overlies and contacts the adjacent side surfaces 83, 84 of the casing 80 of the spin block assembly, and the opposite sides of the block 88. Threaded members 56 extend transversely between the two heating chambers, so that the side wall surfaces of the two heating chambers may be drawn toward each other to engage the two opposite sides of said spin block assembly therebetween, i.e., the opposite side surfaces 83, 84 of the casing 80. Sleeves 91 are positioned within the cavities of the heating chambers, as by welding, to reinforce the walls of the chambers against the force of the threaded members 56. By reason of the high temperature and stress resulting from the temperature and pressure of the melt during operation, the above attachment means is preferable to simply bolting each casing to the adjacent heating chamber, with threaded bores extending into the casing. The apparatus of FIG. 3 also includes an insulating jacket as described above, together with the necessary duct connections, and which are not shown in FIG. 3 for clarity of illustration.

An advantage of the embodiment of FIGS. 3 and 4 resides in the fact that the holders 15 and enclosed spin plates 12 and pistons 76 may be simply removed and replaced without disassembling the heating jacket, and the casing 80 remains fixed to the heating chambers during such an exchange. Only in the event of the total redesign of the spinning head, such as to insert a rectangular spin plate, would the casing 80 need to be exchanged, in which event the threaded members 56 are loosened and all of the components may then be withdrawn one after another.

In the drawings and specification, there has been set forth a preferred embodiment of the invention, and although specific terms are employed, they are used in a generic and descriptive sense only and not for purposes of limitation.

That which is claimed is:

1. A melt spinning apparatus adapted for dividing a molten meterial into a plurality of streams to form synthetic filaments, and comprising a spin block assembly having two opposite sides, said spin block assembly including a spin plate having a plurality of ducts extending therethrough, a tubular spin plate holder supportingly surrounding the periphery of said spin plate and defining cavity means communicating with one face of said spin plate for supplying said molten material to said ducts, and a casing substantially enclosing said holder, with said casing having flat opposite side surfaces which define at least a portion of said opposite sides of said spin block assembly, heating jacket means substantially enclosing said spin block assembly, said heating jacket means including two separate heating chambers disposed adjacent respective ones of said sides of said spin block assembly, with each heating chamber including a side wall surface overlying and contacting the adjacent side of said spin block assembly, and means for releasably interconnecting said two heating chambers to permit selective relative movement with respect to each other and said side wall surfaces of said two heating chambers may be drawn toward each other to clampingly engage said two opposite sides of said spin block assembly therebetween and thereby avoid any air gap between each of the sides of said spin block assembly and the adjacent side wall surface of the heat chambers, and a melt distribution block overlying said spin plate holder and casing, with said melt distribution block being disposed between said two heating chambers of said heating jacket means, and wherein said melt distribution block includes a threaded extension, and said spin plate holder is threadedly mounted on said extension so as to permit the separation thereof by rotation of said spin plate holder with respect to said threaded extension.

2. The melt spinning apparatus as defined in claim 1 wherein said opposite sides of said spin block assembly are essentially flat and parallel to each other, and said side wall surfaces of said two heating chambers are essentially flat and closely conform to the adjacent sides of said spin block assembly.

3. The melt spinning apparatus as defined in claim 2 wherein said means for releasably interconnecting said two heating chambers comprises a plurality of threaded members extending transversely between said two heating chambers.

4. The melt spinning apparatus as defined in claim 1 wherein said tubular spin plate holder has a circular outer periphery, and said casing has an opening of circular cross section closely receiving said holder therewithin.

5. The melt spinning apparatus as defined in claim 3 wherein each of said heating chambers includes a closed internal cavity, and said heating chamber means further includes means for conveying a heated fluid into said cavity of each of said two heating chambers.

6. The melt spinning apparatus as defined in claim 5 wherein said means for conveying a heated fluid into said cavity of each of said two heating chambers comprises parallel heating ducts connected to a common source of a heated fluid, so that the two chambers are heated to essentially the same temperature.

7. The melt spinning apparatus as defined in claim 6 wherein said parallel heating ducts include flexible components, to permit relative movement of said two heating chambers.

8. The melt spinning apparatus as defined in claim 1 wherein said spin block assembly further comprises a piston mounted in said cavity means, said piston having a melt opening extending therethrough.

9. The melt spinning apparatus as defined in claim 8 wherein said melt distribution block includes a melt supply line which extends through said extension, and such that said melt supply line commuicates with said melt opening of said piston whereby a melt may be delivered to said cavity means between said piston and said spin plate.

10. The melt spinning apparatus as defined in claim 9 wherein said spin block assembly further comprises diaphragm means positioned in said cavity means between said piston and said spin plate for biasing said piston against said threaded extension upon pressurized melt being received in said cavity means, and gasket means for forming a seal between said piston and said extension.

11. The melt spinning apparatus as defined in claim 10 wherein said melt distribution block includes opposite sides which are aligned with the opposite sides of said spin block assembly, and wherein said side wall surfaces of said heating chambers are adapted to contact respective ones of the opposite sides of said melt distribution block.

12. A melt spinning apparatus adapted for dividing a molten polymer into a plurality of streams to form synthetic filaments, and comprising a generally rectangular spin block assembly having two generally flat opposite sides which are parallel to each other, and two opposite ends, said spin block assembly including a spin plate having a plurality of ducts extending therethrough, a spin plate holder surrounding and supporting the periphery of said spin plate, with said holder having flat opposite side surfaces which define at least a portion of said opposite side of said spin block assembly, a cover plate overlying said spin plate, and cavity means disposed between the opposing faces of said spin plate and cover plate and communicating with said ducts so as to be adapted for supplying a molten polymer thereto, heating chamber means substantially enclosing said spin block assembly, said heating chamber means including two separate heating chambers disposed adjacent respective ones of said sides of said spin block assembly, with each heating chamber being hollow to define a closed internal cavity and including a side wall surface overlying a directly contacting the adjacent side of said spin block assembly and such that said side wall surfaces of said two heating chambers directly contact respective ones of the opposite side surfaces of said spin plate holder, with said side wall surfaces being essentially flat and closely conforming to the respective sides of said spin block assembly, means for delivering a heated fluid into each of said internal cavities, and means for releasably interconnecting said two heating chambers to permit selective movement with respect to each other and so that said side wall surfaces of said two heating chambers may be drawn toward each other to clamp and hold said spin block assembly therebetween and thereby avoid any air gap between each of the sides of said spin block assembly and the adjacent side wall surface of the heating chamber, and a plurality of separate spacer blocks interposed between the side wall surfaces of said two heating chambers, with each of said spacer blocks positioned adjacent one of said ends of said spin block assembly, and with said spacer blocks having a length not greater than the distance between the opposite sides of said spin block assembly.

13. The melt spinning apparatus as defined in claim 1 wherein at least one of said heating chambers has a generally L-shaped cross sectional outline to define a horizontal leg and a vertical leg, with the forward end of said horizontal leg forming said side wall surface of said heating chamber.

14. The melt spinning apparatus as defined in claim 13 wherein said apparatus further comprises a pump block mounted upon said horizontal leg of said L-shaped heating chamber, with said pump block including a front surface which is in alignment with said side wall surface of such heating chamber.

15. The melt spinning apparatus as defined in claim 14 further comprising a polymer duct means extending through said pump block to said cavity between said spin plate and cover plate, and wherein said pump block includes means for pumping a molten polymer through said duct means to said cavity.

16. The melt spinning apparatus as defined in claim 15 wherein said spin block assembly further includes a spin plate holder surrounding the periphery of said spin plate, with said holder having flat opposite side surfaces, and wherein said cover plate has opposite side surfaces which are generally coplanar with respective ones of the opposite side surfaces of said holder, and such that the opposite side surfaces of said holder and the opposite side surfaces of said cover plate collectively form said opposite sides of said spin block assembly.

17. The melt spinning apparatus as defined in claim 16 wherein said front surface of said pump block and the side wall surface of the opposite heating chamber include mating horizontal shoulders, and said cover plate includes a mating shoulder along each of its opposite side surfaces, whereby said cover plate may be lifted from its operative position between said heating chambers upon said interconnecting means being loosened.

18. The melt spinning apparatus as defined in claim 12 wherein said opposite sides of said spin block assembly are essentially flat and aprallel to each other, and said side wall surfaces of said two heating chambers are essentially flat and closely conform to the adjacent sides of said spin block assembly.

19. The melt spinning apparatus as defined in claim 18 wherein said means for releasably interconnecting said two heating chambers comprises a plurality of threaded members extending transversely between said two heating chambers.

20. The melt spinning apparatus as defined in claim 19 wherein said cover plate includes opposite side surfaces which are generally coplanar with respective ones of the opposite side surfaces of said holder to thereby form a portion of said opposite sides of said spin block assembly.

21. The melt spinning apparatus as defined in claim 19 wherein said threaded members extend lengthwise through said spacer blocks.

22. The melt spinning apparatus as defined in claim 21 wherein said spacer blocks are fabricated from a heat insulating material.

23. The melt spinning apparatus as defined in claim 19 wherein said flat opposite side surfaces of said holder and said side wall surfaces of said two heating chambers are composed of a heat conductive metallic material, and are machined to a smooth finish to facilitate heat transfer thereacross.

24. The melt spinning apparatus as defined in claim 23 wherein said heating chamber means further comprises an insulating jacket substantially enclosing said two heating chambers, with said insulating jacket including an opening aligned with the outlet side of said spin plate.

* * * * *